US005791817A

United States Patent [19]

Carlson

[11] Patent Number: 5,791,817

[45] Date of Patent: Aug. 11, 1998

[54] DITCH DAM

[75] Inventor: Dan S. Carlson, Longmont, Colo.

[73] Assignee: American Innovations, LLC, Erie, Colo.

[21] Appl. No.: 609,728

[22] Filed: Mar. 1, 1996

[51] Int. Cl.[6] ..... E02B 3/10

[52] U.S. Cl. ..... 405/91; 405/90; 405/107

[58] Field of Search ..... 405/36, 38, 39, 405/40, 48, 87, 90, 91, 107, 114, 115, 116, 117, 118

[56] References Cited

U.S. PATENT DOCUMENTS

| | | | |
|---|---|---|---|
| 535,153 | 3/1895 | Witcher . | |
| 536,687 | 4/1895 | Hussey . | |
| 771,821 | 10/1904 | Gleazen . | |
| 1,027,235 | 5/1912 | Cadwallader . | |
| 1,077,996 | 11/1913 | Patrick . | |
| 1,212,633 | 1/1917 | Hanna . | |
| 1,330,957 | 2/1920 | Shaw | 405/91 |
| 1,404,325 | 1/1922 | Schaefer | 405/90 |
| 1,633,395 | 6/1927 | Carlsson | 405/90 |
| 1,645,913 | 10/1927 | McCandless | 405/90 |
| 2,174,845 | 10/1939 | Small | 61/29 |
| 2,592,290 | 4/1952 | Kearsley | 61/29 |
| 2,674,855 | 4/1954 | Taylor | 61/29 |
| 2,821,842 | 2/1958 | Christiansen | 405/90 |
| 3,084,516 | 4/1963 | Coffman | 61/29 |
| 3,518,833 | 7/1970 | Bogart | 405/91 |
| 4,070,864 | 1/1978 | Jarvis | 61/29 |

*Primary Examiner*—Tamara L. Graysay
*Assistant Examiner*—Frederick L. Lagman
*Attorney, Agent, or Firm*—Rick Martin

[57] ABSTRACT

A one-piece plastic back brace for a ditch dam is shaped like the V of the ditch. It has a groove on the top back edge that engages a span pipe which is placed across the ditch. An apron is mounted to the span pipe before the back brace is engaged. The apron folds back over the back brace to form a dam.

6 Claims, 3 Drawing Sheets

DITCH DAM

FIELD OF INVENTION

The present invention relates to an improvement to the art of damming an irrigation ditch.

BACKGROUND OF THE INVENTION

The ditch dam is designed primarily for farm use. It is an improvement to the art of water irrigation. Flood irrigating from a ditch is the traditional way to divert water to a useful purpose on a farm. The present invention provides a more effective way to set the irrigation dam.

FIG. 1 illustrates the conventional way to set an irrigation dam. Farmland 8 has an irrigation ditch 1. The water flow is indicated by arrow $F_1$. A back brace 2 is usually made of a 2×4 board placed across the ditch 1. Vertical slats 3, 4, 5 complete the back brace assembly 10. The dam apron 6 is supported by brace 7 which is also usually a 2×4. The dam apron 6 is placed upstream from the back brace assembly 10.

It can be seen that transporting the five boards and the apron by hand would be a full load for one man. Also, it is time consuming to stack the boards in the proper manner.

The present invention provides the back-brace assembly, the apron, and the span pipe in a lightweight three-piece assembly. See FIG. 2. The distinct advantages of the present invention include the easy transport of multiple dams into the field, the more rapid set-up time, and the more stable final dam. Below are noted other ditch dam patents.

U.S. Pat. No. 535,153 (1985) to Witcher discloses a ditch dam made of canvas. A pole is draped across the ditch. It supports three vertical braces which hold the canvas in a vertical manner. Holes in the canvas provide a controlled water flow.

U.S. Pat. No. 536,687 (1895) to Hussey discloses a canvas apron-type ditch dam. Only a single pole is draped across the ditch. It holds one end of the canvas. The canvas is forced into a semi-cylindrical shape by the water.

U.S. Pat. No. 771,821 (1904) to Gleazen discloses a ditch dam having a metal frame disposed across the ditch. Apron support bars depend from the metal frame. A canvas or rubber apron is held against the support bars by the water.

U.S. Pat. No. 1,027,235 (1912) to Cadwallader discloses a one-piece ditch dam. A metal pole is disposed across the ditch. A "V"-shaped frame depends from the pole. A plurality of arms emanate from the frame. A canvas apron is affixed to the arms.

U.S. Pat. No. 1,077,996 (1913) to Patrick discloses a ditch dam having a pair of crossed hand levers that support pie-shaped plates. A canvas apron is affixed between the plates.

U.S. Pat. No. 1,212,633 (1917) to Hanna discloses a ditch dam having a support pole and a suspended canvas apron. The apron has a burlap tongue. A pitchfork secures the center of the apron and the tongue in the ditch.

U.S. Pat. No. 2,174,845 (1939) to Small discloses a ditch dam. A metal cross bar supports a canvas apron. An anchor strip depends from the middle of the cross bar.

U.S. Pat. No. 2,592,290 (1952) to Kearsley et al. discloses a ditch dam having a triangular apron supported by a cross bar. A center post supports the tip of the apron from the center of the post, much like a kite.

U.S. Pat. No. 2,674,855 (1954) to Taylor discloses an improved, hinged cross bar for a conventional apron-type ditch dam.

U.S. Pat. No. 3,084,516 (1963) to Coffman discloses a "Y"-shaped frame for a ditch dam. A timing mechanism automatically releases the dam.

U.S. Pat. No. 4,070,864 (1978) to Jarvis discloses an adjustable-height ditch dam having a retaining pole which adjusts in height.

SUMMARY OF THE INVENTION

The main object of the present invention is to provide a one-piece ditch dam back brace which offers ease of transport and more stability than conventional back-brace board assemblies.

Another object of the present invention is to provide an integrated apron support rod for the back brace.

Other objects of this invention will appear from the following description and appended claims, reference being made to the accompanying drawings forming a part of this specification wherein like reference characters designate corresponding parts in the several views.

The ditch dam disclosed herein consists of a unibody V-shaped plastic back brace that fits in the ditch. The apron has a slot on the top edge which fits in a groove along the top edge of the back brace. A support pole slides into both the apron slot and back brace groove to support both across the ditch.

The entire assembly is lightweight and easily transported. The V-shape of the back brace provides a firm support for the apron in the ditch.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
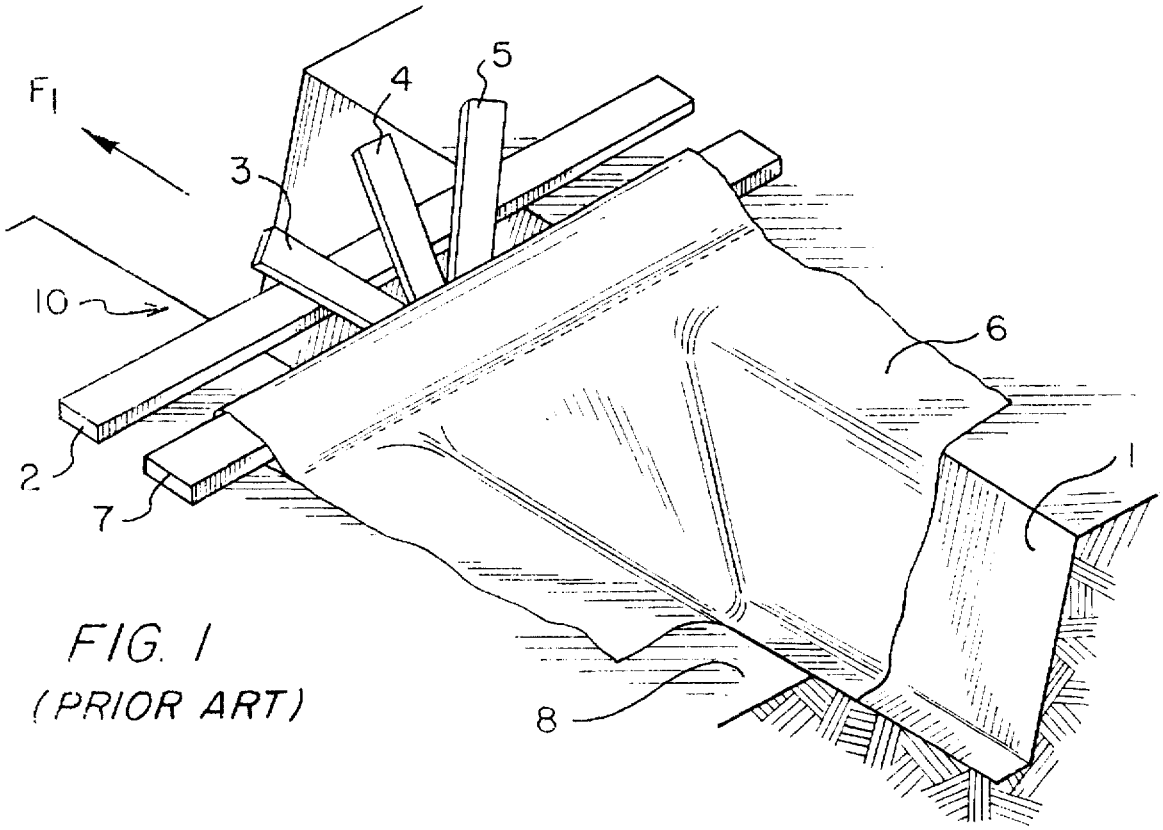
FIG. 1 (PRIOR ART)
FIG. 1 (prior art) is a top perspective view of a traditional 2×4 board ditch dam.
Figure 2:
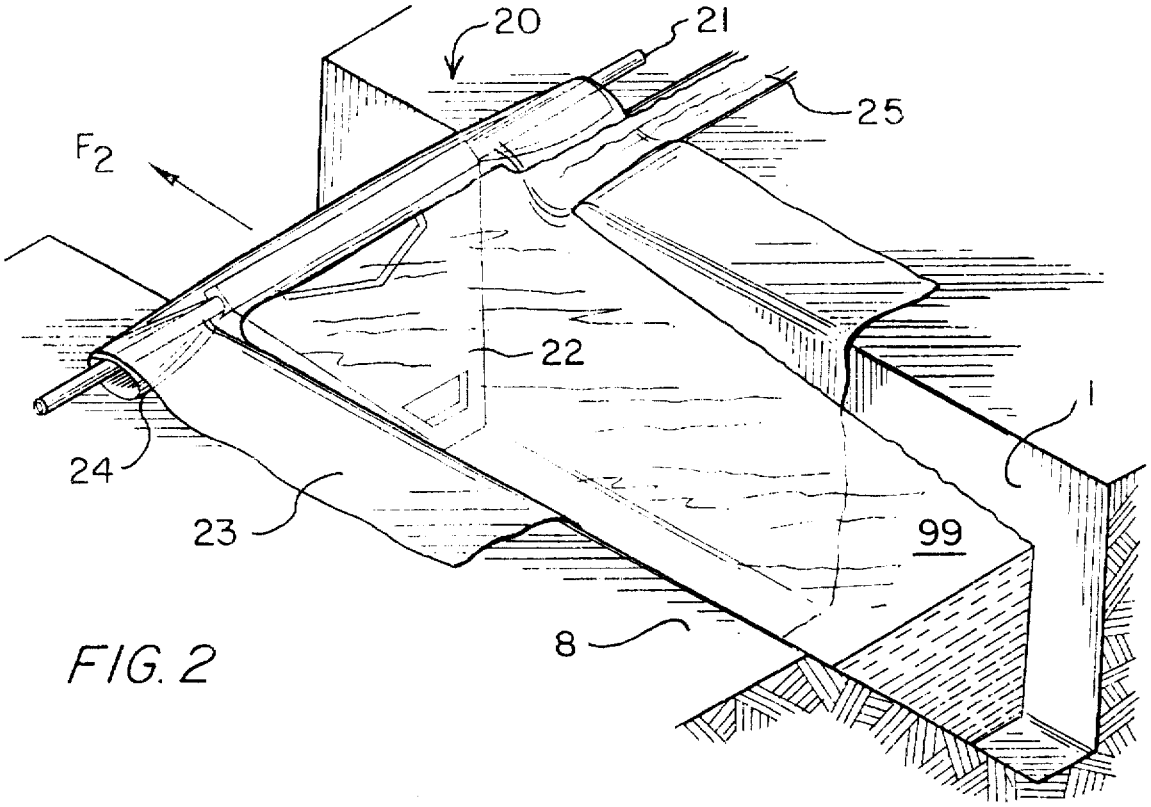
FIG. 2 is a top perspective view of the preferred embodiment.

Referring first to FIG. 2 the farmland 8 and ditch 1 has water 99 which flows in direction $F_2$. The ditch dam assembly 20 consists of a span pipe 21 which supports both the back brace 22 and the apron 23. The apron 23 has a slot 24 along its top edge to accept the span pipe 21. An optional water outfall 25 has been created by digging a trough at the top of the ditch in a known manner.

Figure 3:
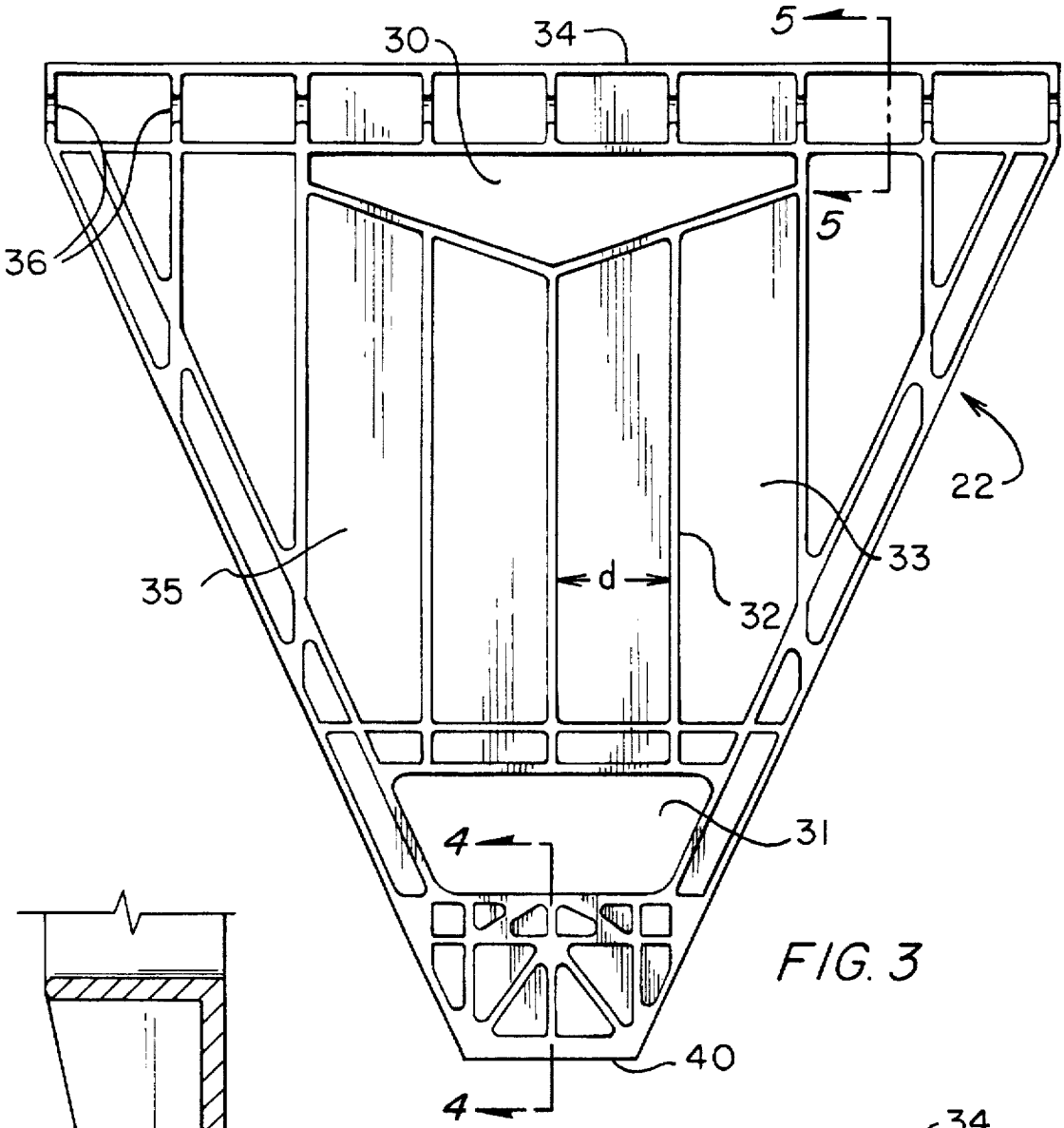
FIG. 3 is a back plan view of the back brace portion of the preferred embodiment.
Figure 4:
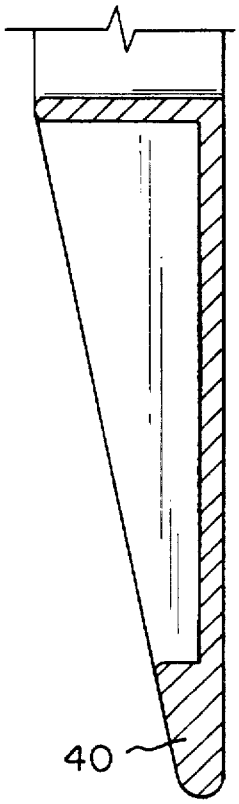
FIG. 4 is a sectional view taken along line A—A of FIG. 3.
Figure 5:
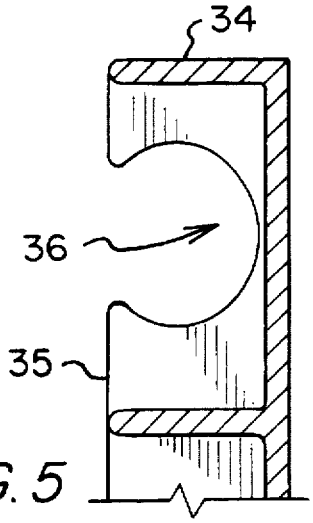
FIG. 5 is a sectional view taken along line B—B of FIG. 3.

Referring next to FIGS. 3, 4, 5 the back brace 22 is seen to have a triangular shape to generally conform to the V-shape of the ditch 1. The rear surface 35 of the back brace 22 is seen to have support ridges 32 and depressions 33 as well as a top edge 34 and a bottom edge 40. The back brace 22 is preferably made of a single-piece plastic mold. Distance d is nominally three inches. The groove 36 removably fastens to the span pipe 21 in the operational mode shown in FIG. 2. The holes 30, 31 in the back brace 22 could be used as flow-through slots by cutting like holes in the apron 23.

Figure 6:
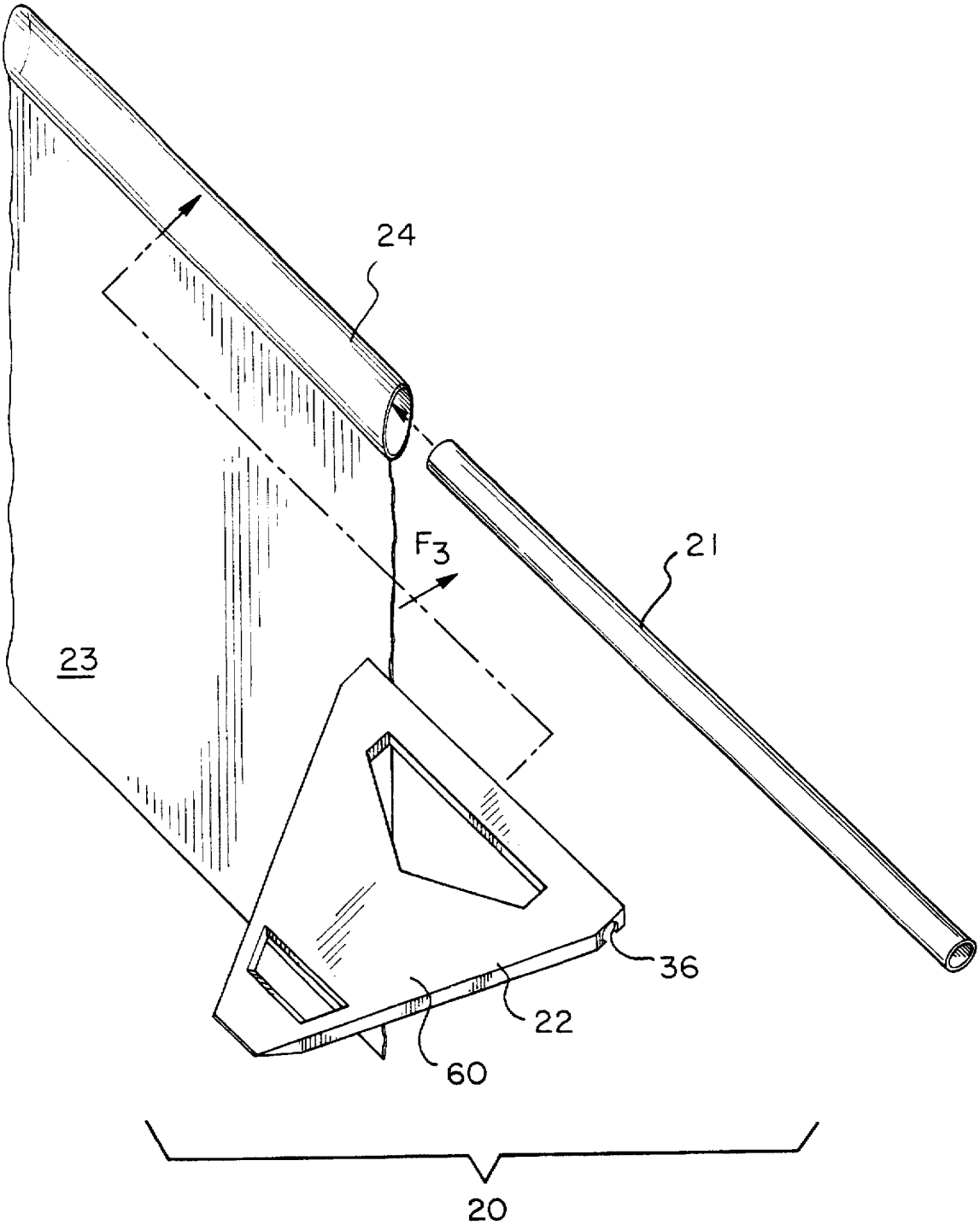
FIG. 6 is an exploded view of the preferred embodiment.

Referring last to FIG. 6 the front surface 60 of the back brace 22 is seen to be smooth. The span pipe 21 slides into the slot 24 of the apron 23. Then the groove 36 is fastened to the span pipe 22 and apron 23 assembly as shown. Then the apron 23 is lifted in direction $F_3$ and folded over the front surface 60 of the back brace 22.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A ditch dam comprising:

a unibody back brace having a shape generally conforming to a ditch;

an apron having a slot along a top edge;

a span pipe removably engaged in the slot; and said back brace further comprising a means to engage the span pipe when the span pipe is set across a ditch inside the slot functioning to maintain the back brace in an upright position, thereby supporting the apron to create a dam.

2. The dam of claim 1, wherein the back brace shape further comprises a V.

3. The dam of claim 1, wherein the means to engage the span pipe further comprises a groove across a top edge of the back brace.

4. A ditch dam comprising:

an apron having a means to engage a span pipe disposed across a ditch functioning to support the apron in an upright manner;

a unibody back brace having a means to engage the span pipe and the apron, functioning to further support the apron downstream from a flow of ditch water;

the means to engage a span pipe further comprises a slot along a top edge of the apron; and the means to engage the span pipe and the apron further comprises a groove along a top back side of the back brace.

5. A method to build a ditch da m comprising the steps of:

inserting a span pipe through a slot in an apron;

bridging a ditch with the span pipe and the apron;

engaging a unibody back brace to the span pipe; and folding the apron onto a front surface of the back brace.

6. A ditch dam comprising:

an apron having a means to engage a span pipe disposed across a ditch functioning to support the apron in an upright manner;

a unibody back brace having a means to engage the span pipe and the apron, functioning to further support the apron downstream from a flow of ditch water; and said unibody back brace further comprises a V shape.

* * * * *